US008418850B2

(12) United States Patent
Arnold

(10) Patent No.: US 8,418,850 B2
(45) Date of Patent: Apr. 16, 2013

(54) PRESENTATION DEVICE FOR A BICYCLE HANDLEBAR GRIP

(75) Inventor: Franc Arnold, Koblenz (DE)

(73) Assignee: RTI Sports Vertrieb von Sportartikeln GmbH (DE)

( * ) Notice: Subject to any disclaimer, the term of this patent is extended or adjusted under 35 U.S.C. 154(b) by 0 days.

(21) Appl. No.: 13/221,153

(22) Filed: Aug. 30, 2011

(65) Prior Publication Data

US 2012/0048765 A1 Mar. 1, 2012

(51) Int. Cl.
*B65D 73/00* (2006.01)

(52) U.S. Cl.
USPC ..... 206/349; 206/478; 206/493; 206/495

(58) Field of Classification Search ..... 206/478, 206/493, 486–488, 495, 378, 349; 53/399
See application file for complete search history.

(56) References Cited

U.S. PATENT DOCUMENTS

| | | | | |
|---|---|---|---|---|
| 1,842,072 | A | | 1/1932 | Collingbourne |
| 2,270,702 | A | * | 1/1942 | Getmansky ..... 24/459 |
| 2,645,340 | A | | 7/1953 | Dow |
| 3,464,545 | A | | 9/1969 | Bailey |
| 5,600,937 | A | | 2/1997 | Erickson et al. |

FOREIGN PATENT DOCUMENTS

| | | | |
|---|---|---|---|
| DE | 9311848.1 | U1 | 10/1993 |
| DE | 202004009963 | U1 | 6/2004 |
| DE | 202008011712 | U1 | 9/2008 |
| EP | 0788978 | A1 | 8/1997 |

* cited by examiner

*Primary Examiner* — J. Gregory Pickett
*Assistant Examiner* — Mollie Llewellyn
(74) *Attorney, Agent, or Firm* — Clements Bernard PLLC; Gregory N. Clements

(57) ABSTRACT

A presentation device for a bicycle handlebar grip (12*a*) comprises an plane base element (14) and an elongate elastic holding element (16*a*). The holding element (16*a*) is provided for holding the grip (12*a*) on the base element (14). Thus, a first portion (16*a*') of the holding element (16*a*) emerges from a first opening (18) on the first end of the grip (12*a*) and a second portion (16") of the holding element (16*a*) emerges from a second opening (20) on the second end of the grip (12*a*). Further, a connection means (22*a*) is provided for mechanically connecting the first and second portions (16*a*', 16*a*") of the holding element (16*a*), to the base element (14). This allows the grip (12*a*) to be pulled away from the base element (14) against the tensile force of the holding element (16*a*), so a person can full fully grip around the bicycle handlebar grip (12*a*).

8 Claims, 1 Drawing Sheet

PRESENTATION DEVICE FOR A BICYCLE HANDLEBAR GRIP

BACKGROUND OF THE INVENTION

1. Field of the invention

The present invention relates to a presentation device for a bicycle handlebar grip.

2. Description of the prior art

Bicycle handlebar grips are offered for sale as accessories for bicycles and have to be presented to a customer or interested person in an appealing manner. In such a situation, a prospective customer should first have the opportunity to look at the bicycle handlebar grip which is arranged in or on the presentation device and, by visual inspection, recognize as many of its features as possible.

For this purpose, it is known to use transparent product packings which are capable to accommodate two bicycle handlebar grips per packing. These packings are closed on all sides, thus fully surrounding the bicycle handlebar grips. For representation of product information, it is possible to arrange e.g. cardboard elements within such transparent packings, with product-related texts or pictures printed on them.

In such transparent product packings, it is disadvantageous that an interested person can only see the presented bicycle handlebar grips but cannot touch them. Since, however, especially the ergonomics and haptics of bicycle handlebar grips are of considerable relevance, it is important to the customer to have the opportunity to touch a given handlebar grip before possibly buying the set of two grips. Particularly, it would be desirable for the customer to be able to grip his/her hand around a bicycle handlebar grip in the same manner as a cyclist would grip his/her hand around this handlebar grip as mounted on a bicycle handlebar.

Further, bicycle handlebar grips can be offered for sale within closed containers, e.g. within a cardboard box. For allowing a customer—before a possible decision to buy a bicycle handlebar grip accommodated in such a sales package—to see or touch this grip, the grip would have to be taken out of the sales package. Then, the customer could view the bicycle handlebar grip and grip around it in adequate manner. Opening the sales packing, however, is a complex process which often is carried out not by the customer alone but only with the aid of a salesperson. If the customer were to open the sales package alone and take out the bicycle handlebar grips, this situation would lead to an increased risk of them getting stolen.

It is an object of the invention to provide a presentation device for a bicycle handlebar grip which makes it possible for an interested person to fully grip his/her hand around the bicycle handlebar grip in a convenient manner.

SUMMARY OF THE INVENTION

According to the invention, the above object is achieved by the features defined in claim 1.

A presentation device for a bicycle handlebar grip comprises an plane base element. This can be e.g. an plane cardboard element, with product information in the form of texts and/or picture printed thereon. This presentation device further comprises an elongate elastic holding element. The holding element serves for holding the bicycle handlebar grip on the base element. This elastic holding element thus establishes a mechanical connection between the grip and the base element. The elastic holding element can be fitted through the bicycle handlebar grip in the longitudinal direction of the grip so that a first portion of the elastic holding element emerges from a first opening on the first end of the bicycle handlebar grip and a second portion of the elastic holding element emerges from a second opening on the second end of the bicycle handlebar grip. Depending on the design of the elastic holding element, said openings can be relatively small-sized openings which e.g. do not need to have the diameter of the handlebar tube.

The elastic holding element can be formed e.g. as elastic string, preferably a rubber string. The rubber core thereof can be enclosed by fibers, thus lending improved sliding properties to the elastic holding element.

According to the invention, the presentation device further comprises a connection means for mechanically connecting the first and second portions of the elastic holding element, each emerging from a respective end of the bicycle handlebar grip, to the base element. Said connection means can be any device which is suited to connect the two portions of the elastic holding element to the base element in a manner precluding that said portions could be inadvertently separated from the base element.

According to the invention, the bicycle handlebar grip is held to the base element with the aid of the elastic holding element in such a manner that an interested person can pull the bicycle handlebar grip away from the base element against the tensile force of the elastic holding element. As a result, a free space will formed between the base element and the bicycle handlebar grip so that the interested person or prospective buyer can full fully seize, or grip around, the bicycle handlebar grip.

Thus, according to the invention, the elastic holding element is designed in such a manner that the bicycle handlebar grip, when its base position, i.e. in a position where it is not pulled by an interested person, is arranged in the immediate vicinity of the base element and preferably touches the base element. For instance, for normally keeping the bicycle handlebar grip pulled against the base element, the elastic holding element may comprise a biasing force. Only if an interested person pulls the bicycle handlebar grip away from the base element, a distance is created between the bicycle handlebar grip and the base element so that the person will have the opportunity to place the fingers of his/her hand around the bicycle handlebar grip and to grip fully around it.

Thus, by the presentation device of the invention, it is made possible for an interested person, before buying a bicycle handlebar grip, to place his/her hand fully around the grip in a simple manner without the need to remove the bicycle handlebar grip from the presentation device or to take out the grip from a packing. At the same time, however, the bicycle handlebar grip will remain connected to the base element by the elastic holding element also while being gripped by the interested person. Consequently, the interested person cannot remove the bicycle handlebar grip without application of violent force or bothersome tampering. As a result, theft protection is improved.

It is preferred that the connection means for connecting the first and second portions of the elastic holding element to the base element has the configuration described hereunder:

The base element comprises a first and a second recess. For holding the bicycle handlebar grip on the base element, the first portion and the second portion of the elastic holding element can be fitted through a respective one of said recesses. By use of a fixing means, the first and the second portion of the elastic holding element are fixed in such a manner on the side of the base element opposite to the to-be-attached bicycle handlebar grip that they cannot be entirely pulled out from the first and second recesses in the direction of the bicycle handlebar grip. According to a preferred embodiment, said fixing means is configured to allow virtually no pulling of the first and second portions of the elastic holding element from the first and second recesses of the base element. For instance, the fixing means can be realized in the form of a counter-abutment which is arranged on the side of the base element opposite the to-be-attached bicycle handlebar grip and which will prevent that the first and second portions of the elastic holding element could be pulled out.

According to a particularly preferred embodiment, the fixing means is realized in the form of a pin fastened to the first and/or the second portion of the elastic holding element. In such an arrangement, the elastic holding element is connected to a central region of the pin. Starting from this central region, the two ends of the pin extend away from the elastic holding element. Said pin be made e.g. of metal. The cross section of the pin is selected to the effect that the pin can be fitted through the first and/or second recess in the base element.

Preferably, said pin is pivotable relative to the longitudinal direction of the elastic holding element in such a manner that the pin will extend substantially parallel to the elastic holding element. Since the elastic holding element is connected to the pin only at one point, pivoting the pin relative to the elastic holding element is possible in a simple manner. Thus, the pin is pivotable relative to the elastic holding element to the effect that the pin will be arranged parallel to the elastic holding element and then can be fitted through one of the two recesses in the base element. For this purpose, the pin is preferably made of a stiff material. As soon as the pin has been pushed fully through the opening, it will move up again into an orientation at an angle relative to the longitudinal direction of the holding element, thus preventing that the elastic holding element can be pulled out again from the recess formed in the base element. If a pulling force is exerted on the elastic holding element, the pin preferably is arranged at an angle of about 90° relative to the longitudinal direction of the holding element.

In the above manner, the first portion of the elastic holding element, e.g. the first end thereof, can be mechanically connected to the base element. Then, the second end of the elastic holding element can be fitted through the bicycle handlebar grip which is to be presented. In a next step, said second end will be pushed through the second recess of the base element in a manner corresponding to that described with respect to the first end, thus safely connecting the bicycle handlebar grip to the base element. The length of the elastic holding element is preferably selected in such a manner that the bicycle handlebar grip, unless being pulled back from the base element, is arranged in the immediate vicinity of the base element and particularly touches the same.

In a similar manner, a further bicycle handlebar grip can be fastened on the opposite side of the base element, while, for fastening such a further grip, use can be made of the same recesses as for the first bicycle handlebar grip. By way of alternative, it is also possible to arrange the two bicycle handlebar grips on one side of the plane base element above each other, side to side with each other or diagonally to each other, which would require two further recesses in the base element. In all embodiments, it is possible for an interested person to fully grip around the bicycle handlebar grips by pulling them away from the base element.

As an alternative to said pin, also other fixing means can be selected which are suited to be fitted through the recesses in the base element and to form a counter-abutment on the opposite side of the base element, thus preventing that the elastic holding element could be pulled out from the recesses of the base element.

Alternatively, it can be provided that the base element comprises no recesses and the ends of the elastic holding element are connected to the base element in another manner.

According to an alternative embodiment, the fixing means can be formed in that, on the side of the base element opposite to the to-be-held grip, the first and the second portion of the elastic holding element, i.e. the first and second ends thereof, are connected—preferably knotted—to each other. Thus, the elastic holding element is of an annular configuration. Preferably, on the side of the base element opposite to the first to-be-held bicycle handlebar grip, the elastic holding element can be fitted through a second bicycle handlebar grip so that, by the annular elastic holding element, a respective grip is held on each side of the base element.

In case that a pin is used as fixing means, this pin can comprise an opening in its central section for fitting the first or second end of the elastic holding element therethrough.

It is preferred that the presentation device of the invention does not comprises additional components, e.g. in the form of a transparent plastic packing or the like, arranged around the bicycle handlebar grip which is to be presented.

The presentation device of the invention is distinguished especially by its simplicity so that it can be produced in a very economical manner. The device is thus suited especially for presentation of less highly-priced bicycle handlebar grips whereas, if these were offered in a very prestigious packing, the customer would get the impression that a large part of the purchase price had been used already for the design of the mere product packing as such.

BRIEF DESCRIPTION OF THE DRAWINGS

A full and enabling disclosure of the present invention, including the best mode thereof, enabling one of ordinary skill in the art to carry out the invention, is set forth in greater detail in the following description, including reference to the accompanying drawing in which.

DETAILED DESCRIPTION OF PREFERRED EMBODIMENTS

Figure 1:
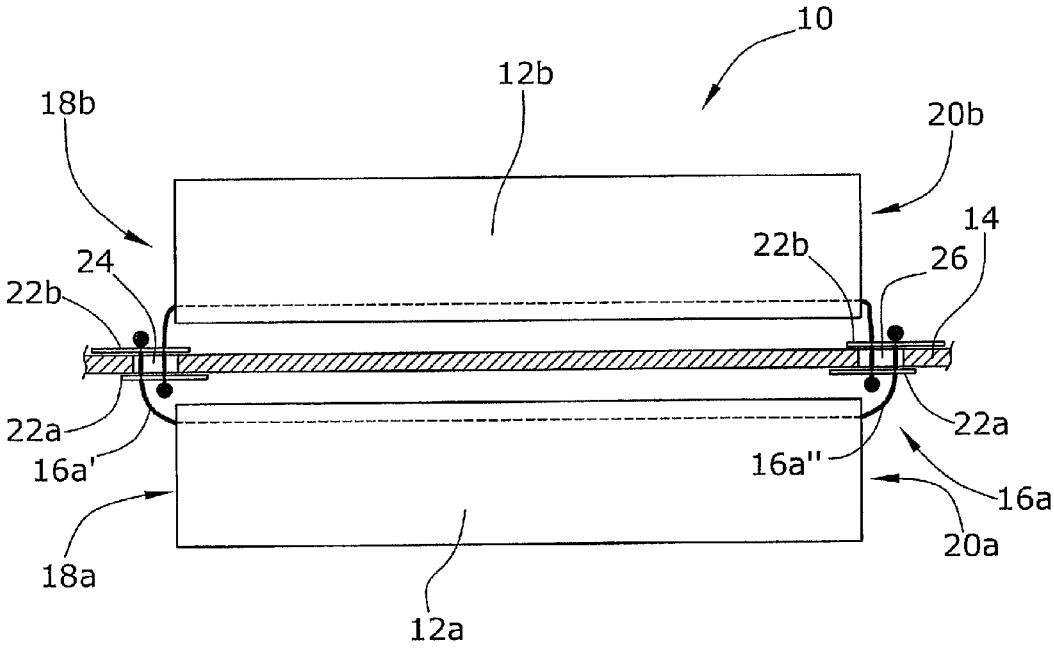
FIG. 1 is a partially sectional plan view of the presentation device of the invention.

In FIG. 1, the presentation device 10 of the invention is shown from above, wherein a respective bicycle handlebar grip 12*a*,12*b* is arranged on both sides of the base element 14. Base element 14 comprises two recesses 24,26, with the first portion 16*a*' and the second portion 16" of the elastic holding element 16*a* fitted through said recesses from below. Arranged closely above base element 14 are the two metal pins 22*a* which in their central section comprise a hole (not illustrated) with the elastic holding element 16*a* guided therethrough. Above said two metal pins 22*a*, the two ends 16*a*', 16*a*" of the elastic holding element 16*a* are knotted so that they cannot be pulled through this hole. The elastic holding element 16*a* is fitted through the lateral openings 18*a*,18*b* and 21*a*,21*b* in the two grips 12*a*,12*b*.

For assembly of the presentation device 10, said metal pins 22*a* will be oriented substantially parallel to the longitudinal direction of the elastic holding element 16*a* and be fitted through the recess 24 and respectively 26. Thereafter, the metal pins 22*a* will assume a substantially perpendicular orientation relative to the longitudinal direction of the elastic holding element 16*a*, thus preventing that they can be pulled back through recess 24 or 26 in a downward direction in FIG. 1.

The second bicycle handlebar grip 12*b* is fastened to the upper side of base element 14 in a manner corresponding to the arrangement described above.

Figure 2:
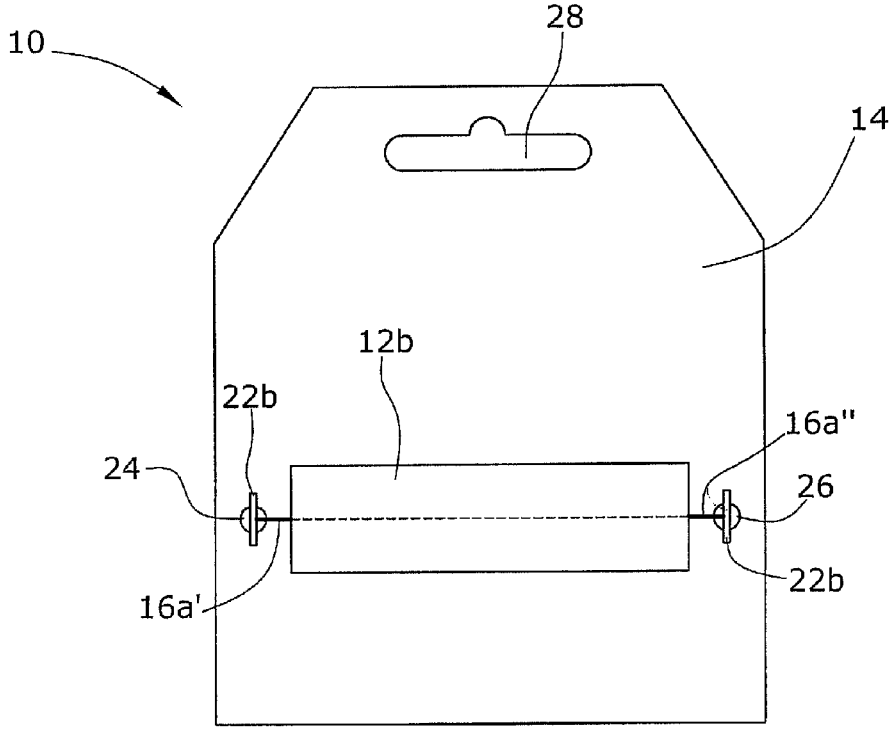
FIG. 2 is a lateral view of the presentation device of the invention.

In FIG. 2, the presentation device 10 of the invention is illustrated in lateral view. In this Figure, there is also shown a third recess 28 of base element 14 which is used for hanging up the presentation device 10.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A presentation device for a bicycle handlebar grip, said presentation device comprising:

a plane base element, first and second bicycle handlebar grips, an elongate elastic holding element for holding the bicycle handlebar grips on the base element, said elastic holding element being fitted through the bicycle handlebar grips in the longitudinal direction of the bicycle handlebar grip so that a first portion of the elastic holding element emerges from a first opening on a first end of the bicycle handlebar grip and a second portion of the elastic holding element emerges from a second opening on a second end of the bicycle handlebar grip, and a connection means for mechanically connecting the first and second portions of the elastic holding element to the base element, each of said portions emerging from a respective end of the bicycle handlebar grips, wherein the bicycle handlebar grips are held to the base element with the aid of the elastic holding element in such a manner that the bicycle handlebar grips can be pulled, by an interested person, away from the base element against the tensile force of the elastic holding element, so that a free space is formed between the base element and the bicycle handlebar grips and said interested person can fully grip around the bicycle handlebar grips, and wherein said connection means is on the side of the base element opposite to the first bicycle handlebar grip which is to be held, the first and the second portion of the elastic holding element are connected to each other so that the elastic holding element is of an annular configuration, wherein the elastic holding element is fitted through the second bicycle handlebar grip.

2. A presentation device for a bicycle handlebar grip, said presentation device comprising:

a plane base element, at least one bicycle handlebar grip an elongate elastic holding element for holding the bicycle handlebar grip on the base element, said elastic holding element being fitted entirely through the bicycle handlebar grip in the longitudinal direction of the bicycle handlebar grip so that a first portion of the elastic holding element emerges from a first opening on a first end of the bicycle handlebar grip and a second portion of the elastic holding element emerges from a second opening on a second end of the bicycle handlebar grip, and a connection means for mechanically connecting the first and second portions of the elastic holding element to the base element, each of said portions emerging from a respective end of the bicycle handlebar grip, wherein the bicycle handlebar grip is held to the base element with the aid of the elastic holding element in such a manner that the bicycle handlebar grip can be pulled, by an interested person, away from the base element against the tensile force of the elastic holding element, so that a free space is formed between the base element and the bicycle handlebar grip and said interested person can fully grip around the bicycle handlebar grip.

3. The presentation device for a bicycle handlebar grip according to claim 2, wherein said connection means for mechanically connecting the first and second portions of the elastic holding element to the base element is formed in that the base element comprises a first and a second recess for holding the bicycle handlebar grip on the base element, the first portion and the second portion of the elastic holding element can be fitted through a respective one of said recesses, and wherein, by a fixing means, the first and the second portion of the elastic holding element are fixed in such a manner on the side of the base element opposite to the to-be-attached bicycle handlebar grip that they cannot be entirely pulled out from the first and second recesses in the direction of the bicycle handlebar grip.

4. The presentation device for a bicycle handlebar grip according to claim 3, wherein the fixing means is realized in that a pin is fastened to the first and/or the second portion of the elastic holding element in such a manner that the elastic holding element is connected to a central region of the pin and, starting from said central region, two ends of the pin extend away from the elastic holding element, the pin having such a cross section that the pin can be fitted through the first and/or second recess in the base element.

5. The presentation device for a bicycle handlebar grip according to claim 3, wherein the fixing means is realized in that, on the side of the base element opposite to the bicycle handlebar grip which is to be held, the first and the second portion of the elastic holding element are connected so that the elastic holding element is of an annular configuration, wherein, on the side of the base element opposite to a first bicycle handlebar grip which is to be held, the elastic holding element is fitted through a second bicycle handlebar grip.

6. The presentation device for a bicycle handlebar grip according to claim 2, wherein the base element is made of cardboard and comprises a third recess used for hanging up the presentation device.

7. The presentation device for a bicycle handlebar grip according to claim 4, wherein the pin comprises an opening in its central section for fitting the first or second portion of the elastic holding element therethrough.

8. The presentation device for a bicycle handlebar grip according to claim 4, wherein the pin is pivotable relative to the longitudinal direction of the elastic holding element in such a manner that the pin extends substantially parallel to the elastic holding element.

* * * * *